United States Patent [19]

Rizzardo

[11] Patent Number: 4,685,160

[45] Date of Patent: Aug. 11, 1987

[54] PORTABLE BED ASSEMBLY

[75] Inventor: Dennis P. Rizzardo, Phoenixville, Pa.

[73] Assignee: McKesson Corporation, San Francisco, Calif.

[21] Appl. No.: 726,810

[22] Filed: Apr. 25, 1985

[51] Int. Cl.[4] ..... A61G 7/00; A47C 19/00

[52] U.S. Cl. ..... 5/68; 5/60; 5/66; 5/201; 5/202; 5/285

[58] Field of Search ..... 5/60, 66, 67, 68, 69, 5/285, 201, 202

[56] References Cited

U.S. PATENT DOCUMENTS

| | | | |
|---|---|---|---|
| 131,968 | 10/1902 | Perkins | 5/202 |
| 3,281,141 | 10/1966 | Smiley | 269/325 |
| 3,447,170 | 6/1969 | Spitz . | |
| 3,503,082 | 3/1970 | Kerwit | 5/67 |
| 3,665,528 | 5/1972 | Kjellberg et al. | 5/67 |
| 3,898,702 | 8/1975 | Goodman | 5/68 |
| 4,097,939 | 7/1978 | Peck et al. | 5/66 |
| 4,103,170 | 7/1978 | Spradlin | 5/82 R |
| 4,139,917 | 2/1979 | Fenwick | 5/66 |
| 4,176,415 | 12/1979 | Dickerson | 5/66 |
| 4,202,062 | 5/1980 | Marcyan | 5/285 |
| 4,361,917 | 12/1982 | Wilson | 5/68 |
| 4,403,357 | 9/1983 | Degen | 5/66 |
| 4,613,997 | 9/1986 | Langdale | 5/202 |

FOREIGN PATENT DOCUMENTS

| | | | |
|---|---|---|---|
| 130409 | 11/1932 | Austria | 5/66 |
| 530861 | 7/1955 | Italy | 5/66 |

*Primary Examiner*—Alexander Grosz

*Attorney, Agent, or Firm*—Dilworth, Paxson, Kalish & Kauffman

[57] ABSTRACT

A portable three piece bed assembly is disclosed comprising a foldable spring deck adapted to be easily mounted on a frame assembly which further separates into two pieces to permit easy assembly, disassembly, and transportation of the bed assembly unit by a single individual wherein the unit comprises a body supporting assembly including a multiple-position, back-supporting member and multiple-position, leg and knee supporting members.

17 Claims, 13 Drawing Figures

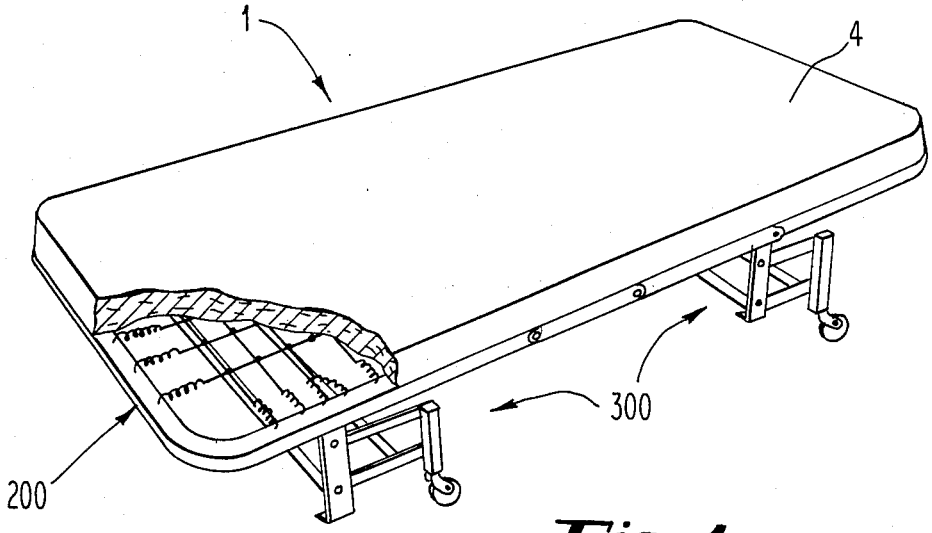
Fig. 1
Fig. 2
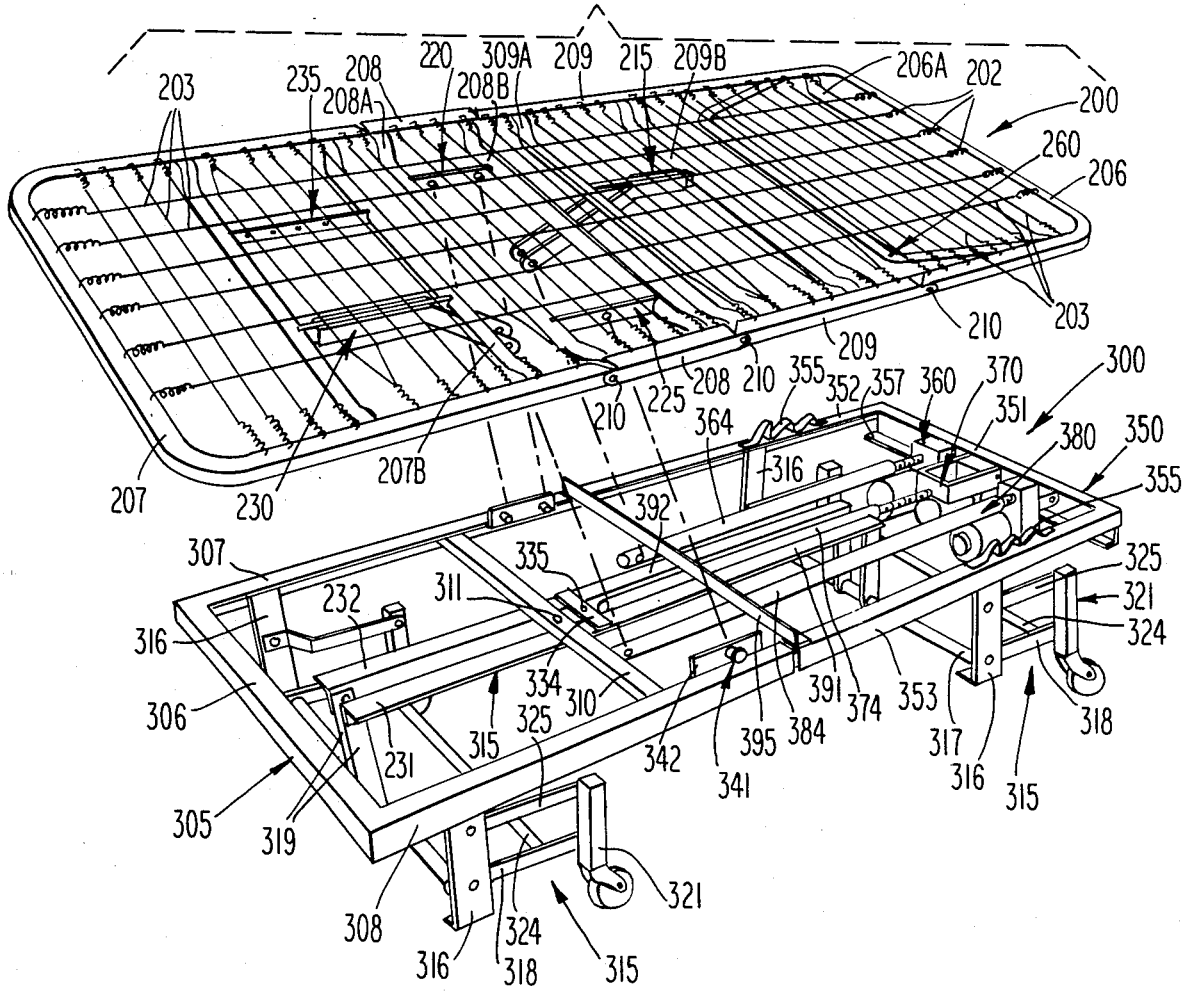

PORTABLE BED ASSEMBLY

BACKGROUND OF THE INVENTION

1. Field of the Invention.

This invention relates various unique features in a body supporting assembly and more paticularly to a portable body supporting assembly which can be disassembled into component parts for ease of handling and still yet more particularly to a three piece multi-positional fully portable, hospital bed assembly which is especially useful in the home health care environment and can be assembled, disassembled, and transported by a single individual.

2. Information Disclosure and Objects of the Invention.

Most convalescent and/or hospital beds are heavy, cumbersome, non-portable units since the mechanisms needed to adequately provide the multi-positional features required in today's state of the art beds are not conducive to light weight units.

Moreover, most of such beds were developed for and in the context of a hospital environment, and thus did not address such needs such as convenience and portability.

The reality of today's marketplace however, has substantially changed various requirements of the hospital supply industry and in particular, with the advent of home health care and various regulations restricting the length of stay in hospitals, patients have been encouraged if not required to convalesce in a non-hospital environment and more particularly, in the home, where convalescing equipment and supplies are generally rented, delivered and removed after a period of convalescence.

While the patient and/or individual convalescing in ones home may require technologically sophisticated equipment and supplies including multi-positional beds and the like, most suppliers of beds and/or body supporting assemblies which are multi-positional have not developed suitable portable devices.

Applicant herein and others have developed various multi-positional units for use in emergency situations and which may, for example temporarily be used as bed supporting assemblies, however, these do not fill the needs or the technological requirements demanded in today's hospital and/or health care environments, where a comfortable, long lasting, multi-positional bed is preferred.

Another attempt to date to fill this need has been made in connection with the typical unitary spring frame assembly which can be split into two sections and is generally held together by helical spring components. These units however do not provide for a spring deck assembly seperable from the frame assembly and in practice require two individuals for delivery and installation purposes. Moreover, these units, have not generally been provided with many of the features required by today's needs, including, for example, motor driven actuated controls to provide multiple positional assemblies. Furthermore, the addition of such features would be self-defeating, in that they would add weight and thus inhibit the portability feature of the unit.

It is therefore an object of the present invention to provide a portable assembly which cures the problems associated with the known units including those recognized hereinbefore.

It is another object of the present invention to provide a novel multi positional body supporting assembly, which includes various unique components.

Another object of the present invention is to provide a multi-positional body supporting assembly which is portable and which may include automatic controls and actuators and/or motor driven assemblies to assist positional changes in the body supporting assemblies.

Still yet another object of the present invention is to provide a body supporting assembly which is fabricated of multiple components which are easily assembled and disassembled to aid in the portability of the unit.

Still yet a further object of the present invention is to provide a three component system wherein the spring deck is readily removed from the frame assembly and wherein the spring deck readily folds into a unit which can be transported by a single individual and wherein the frame assembly is readily divisible into two component parts which may also be transported by a single individual.

Other objects will be appreciated by those knowledgeable in this art from a review of the drawings, specifications, and claims of this application.

BRIEF DESCRIPTION OF THE DRAWINGS

FIG. 1 is a perspective view of the bed assembly of the present invention with the mattress partially cut away.

FIG. 2 is an exploded view of the assemblies of the present invention illustrating the component deck and frame assemblies.

DETAILED DESCRIPTION OF THE PREFERRED EMBODIMENT

Figure 3:
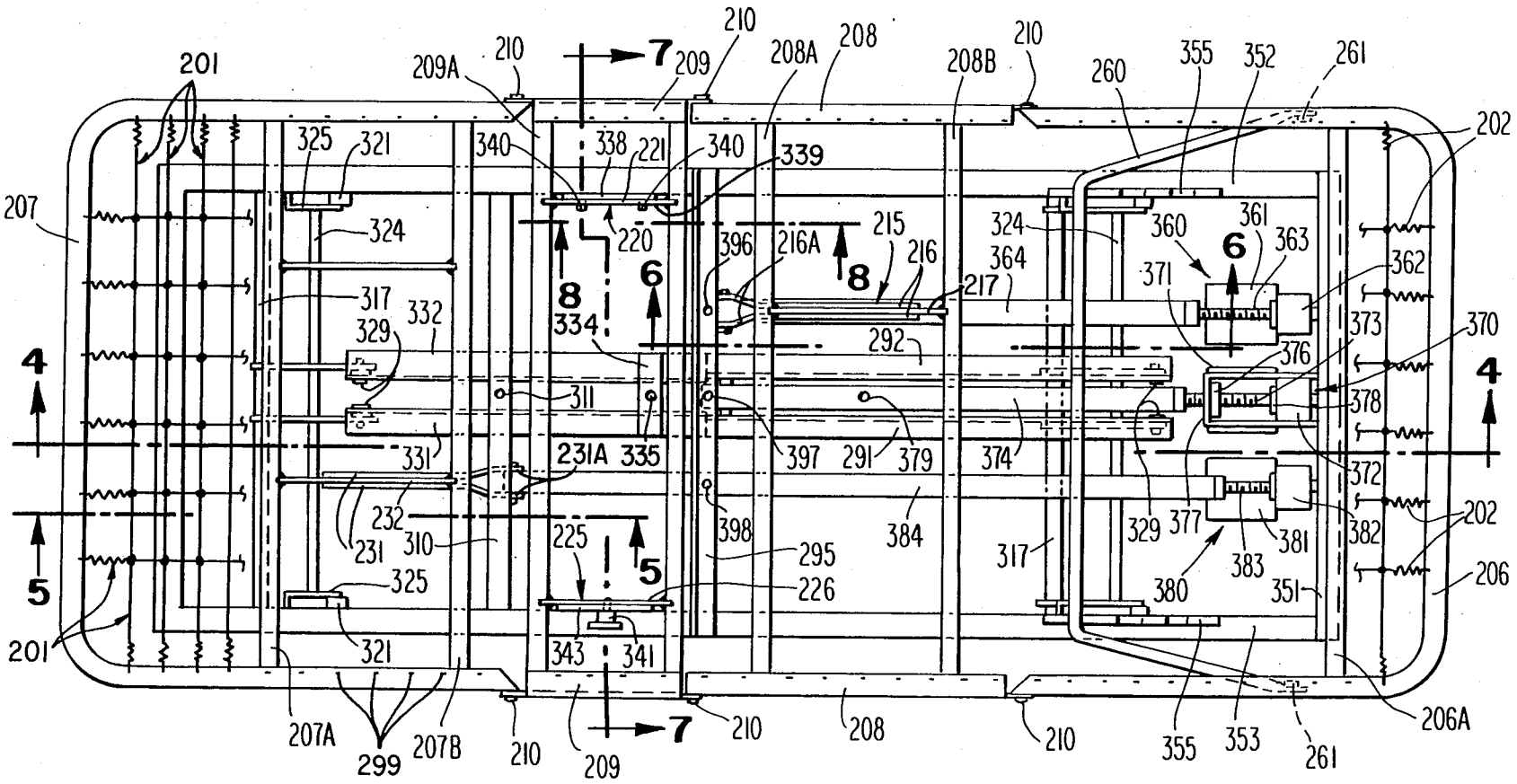
FIG. 3 is a plan view of the assemblies of the present invention with the spring deck partially cut away.

Turning now to FIG. 1 of the present invention, a complete bed assembly 1 is shown having spring deck 200 being supported by frame assembly 300 to support mattress 4.

In FIG. 2, spring deck 200 is shown in exploded view in a manner illustrating its assembly with frame assembly 300. Thus when viewing FIGS. 2 and 10, it can be seen that unit or assembly 1 of the present invention can after removal of mattress 4 be divided into three main component parts comprising spring deck 200 and frame assembly 300 which further comprises and is divisible into head assembly 305 and foot assembly 350.

1. Components of Unit

The component parts of spring deck 200 can best be seen in FIGS. 2 and 4 through 6 as comprising spring members 201 including a helical member 202 attached to deck frame 205 through openings 299, spring 201 having intermediate portions 203 between each pair of helical springs 202. Intermediate portions 203 of spring members 201 are attached to foot end 206 and head end 207 by counterpart helical springs 202 which are likewise used to attach intermediate portions 203 strung between the side frame members (e.g. 208 and 209). Thus, intermediate wire members 203 strung between the side frame members are at right angles to wires 203 strung between the end spring deck members which form a resilient bedding surface by virtue of the perpendicular stringing of the wire members and their attachment to spring deck 200 by helical members 202. Spring deck 200 further comprises foot support bar 260, knee lifting fork 215, stud saddle 220, release pull saddle 225, back lifting fork 230, and head spacer bar 235.

Figure 7:
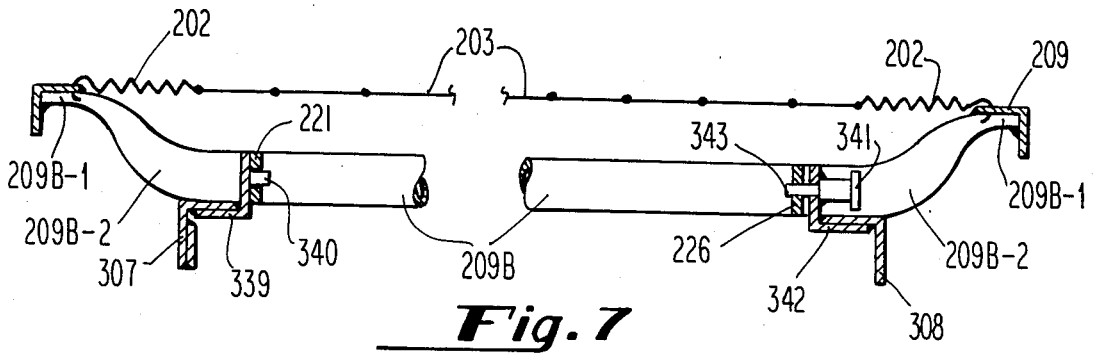
FIG. 7 is a sectional view taken along the lines 7—7 in FIG. 3.
Figure 8:
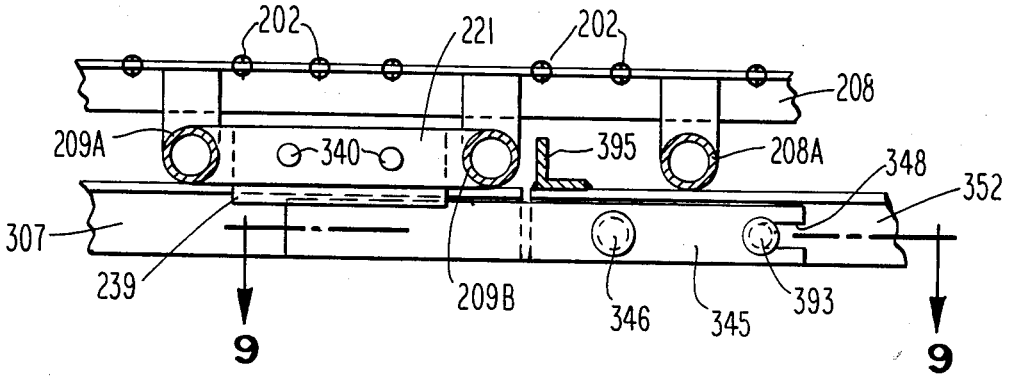
FIG. 8 is a sectional view taken along the lines 8—8 in FIG. 3.

Referring now to FIG. 3, it can be seen that spring deck 200 is comprised of angle-irons with foot frame deck 206 being generally U-shaped and pivotally connected to intermediate knee deck members 208 which in turn are pivotally connected to saddle deck members 209 which is pivotally connected with generally U-shaped back frame deck 207 with all pivotal connections being made by rivet members, generally designated 210. Foot deck 206 further comprises supporting member 206A which is a tubular member which is configured and welded to foot frame 206 in the same manner as tubular member 209B, FIG. 7. Knee deck 208 likewise has tubular cross support members 208A and 208B as does back section deck 207, having two tubular support members 207A and 207B. Saddle section deck 209 also has two tubular support members 209A and 209B. FIG. 7 illustrates that each of the above mentioned tubular members comprise a tubular section which is in this instance designated generally as 209B and lies beneath intermediate wire 203, which is suspended by helical springs 202 connected to saddle deck 209. Saddle deck members 209 are fabricated of angle iron having openings 299 into which the ends of helical springs 202 are inserted. Tubular cross members 206A, 207A and B, 208A and B and 209A are all generally configured in the same manner as member 209B illustrated in FIG. 7; namely, 209B has two end portions 209B-1 which are formed to rest in fitted position with angle iron 209 by having upwardly bending portions 209B-2 finished to form fitted portions 209B-1 which are in the preferred embodiment welded to the angle iron members which in this case are 209.

With reference to FIGS. 2 through 6 it can be seen that knee lifting fork 215 comprises two fork shaped members 216 each welded to intermediate member 217 which in turn is welded to and in fitted relationship with tubular members 208A and 208B. Lower fork members 216A, shown in FIG. 3, diverge outwardly and contain openings 218. Stud saddle 220 contains member 221 which is welded and in fitted arrangement with tubular members 209A and 209B and further contains openings 222. Release pull saddle 225 contains member 226 which is welded to and in fitted relationship with tubular members 209A and 209B and includes opening 227. Back lifting fork 230 includes two fork members 231 which are welded to intermediate member 232 which is welded to and in fitted relationship with tubular members 207A and 207B and has downwardly extending portions 231A which diverge as is best seen in FIG. 3 and which contain at their downwardly extending ends openings 233 (FIG. 2). Back spacer bar 235 which is welded to and in fitted relationship with tubular members 207A and 207B is provided in the preferred embodiment to further strengthen tubular members 207A and 207B and their interconnection with head lifting fork 230 as it is pivotally moved upwardly and downwardly with back section deck 207 as may be seen in FIGS. 3 and 6. Foot support bar 260 which is a generally U-shaped member is pivotally connected to foot section deck 206 by rivet members 261.

Turning now to FIGS. 2, 3, 4 and 10 it can readily be seen that frame assembly 300 comprises a generally U-shaped head section 305 and a generally U-shaped foot section 350. Head frame assembly 305 is fabricated of angle iron and comprises end section 306 and is integral with two side sections 307 and 308. Cross member 310 is welded to side members 307 and 308 and contains opening 311. Head assembly 305 also includes a high-low leg assembly generally indicated as 315 which includes stationary side members 316 which are welded to side members 307 and 308 of frame assembly 305 mounted to which are rotatably journaled tubular members 317 which span the width of frame assembly 305. Outermost lever arms 318 are attached and mounted to tubular member 317 and are practically flush with the innermost surfaces of stationery supports 316. Lever arms 319 are rotatably mounted about pin 329 and fixedly mounted with tubular members 317. The complementary leg assemblies 320 have leg members 321 having castors 322 and wheels 323 mounted thereto with lever arms 318 being pivotally attached to the lowermost portion of leg members 321. Second generally Z-shaped lever arms 325 are pivotally mounted to both stationary supports 316 by rivet members 326 and to leg members 321 by rivet members 327 forming a generally parallelogram-like assembly with members 316, 318, and 321, wherein members 318 and 325 remain parallel with each other throughout the movement of high-low leg assembly 315. Fixedly attached to lever arms 318 are tubular members 324 which traverse the width of frame assembly 300 and are welded to lever arms 318. While high-low leg assembly 315 was described in connection with back frame assembly 305 and in particular with the left-most assembly shown in FIG. 4, it is understood that not only is there a corresponding leg assembly 315 in conjunction with back frame assembly 308, but an identical assembly is used in conjunction with foot frame assembly 350 which has foot end 351 and side assemblies 352 and 353. Thus, high-low leg assemblies 315 all have identical components which function identically and are identically numbered and mounted.

High-low angle assembly 330 of back frame assembly 305 comprises generally L-shaped angle irons 331 and 332 which are each respectively pivotally mounted with each of the lever arms 319 each containing corresponding openings 333 (not shown for member 331). Welded to angle iron 331 and 332 is spacer plate 334 which functios to maintain in conjunction with lever arms 319, angle irons 331 and 332 at a predetermined distance of separation. Spacer plate 334 contains opening 335.

Back assembly 305 includes slide-off stud 338 welded to frame assembly 307 by virtue of flange 339 which together forms generally L-shaped slid off stud means 338 which additionally has studs 340 for fitted engagement into openings 222 of stud saddle 220 of spring deck 200. Spring actuated release pull means 341 (See e.g. FIG. 7) includes a generally L-shaped plate 342, the underside of which is welded to side frame assembly 308, and pin 343 for fitted engagement with opening 227 of release pull saddle 225 of spring deck 200. Back frame assembly 305 further includes complementary tongue portions 345 welded respectively to side assemblies 307 and 308 each containing receptacles 348 and spring pull mechanisms 346 having pins 347.

Foot frame assembly 350 as was previously indicated also contains high-low leg assembly 315 attached respectively to side frame foot assemblies 352 and 353 to which is also attached selection ratchets 355. A generally L-shaped channel 357 is welded to foot frame end assembly 351 to which knee deck actuator 360, high-low actuator 370 and back deck actuator 380 are pivotally attached. Lever arms 319 of high-low leg assembly 315 for foot frame assembly 350 are connected to channel arms 391 and 392. Side frame assembly members 352 and 353 each contain head means 393 for engagement with receptacles 348, and openings 394 for fitted engagement with pins 347 of spring pull mechanisms 346. Generally L-shaped angle iron 395 is welded to the top portions of side frame assembly members 352 and 353 as shown in FIG. 10 and contains opening 396, 397 and 398.

Knee deck actuator 360 comprises motor 361, gear box 362, and screw 363 all of which are functionally interconnected with each other to cause tubular member 364 which is in threaded engagement with screw 363 to extend toward and retract away from gear box 362 pursuant to the actuation of motor 361. Likewise high-low actuator 370 contains motor 371 functionally interconnected with gear box 372 and screw 373 which is in threaded engagement with tubular member 374 to extend and retract tubular member 374 as a function of actuation of motor 371, in the same manner as described in connection with actuator 360. In like fashion back deck actuator 380 contains motor 381 connected with gear box 382 and screw 383 which is in threaded engagement with tubular member 384 all of which are functionally interconnected to extend and retract tubular member 384 in response to actuation of motor 381.

2. Assembly of Unit

Figure 10:
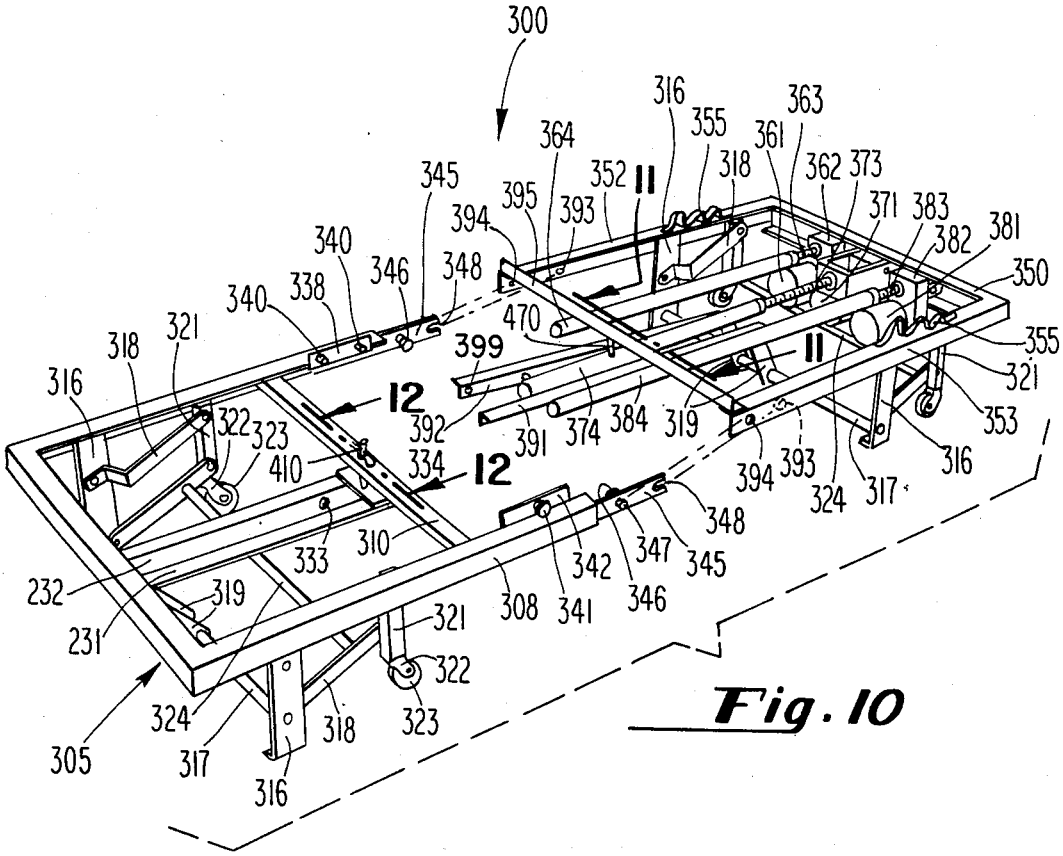
FIG. 10 is a view in perspective illustrating the disassembly of the two component parts of the frame assembly of the present invention.
Figure 12:
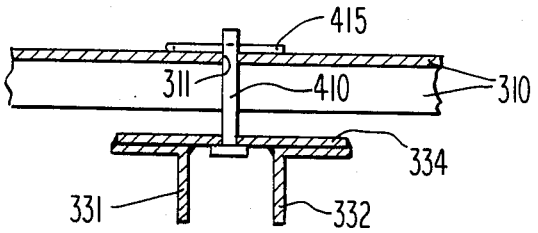
FIG. 12 is a sectional view taken along the lines 12—12 of FIG. 10.

In assembling the component parts of body support device 1 reference is first made to FIG. 10 where the components of frame assembly 300, namely back frame 305 and foot frame 350 are engineered to preferably be assembled and dissembled when actuators 360 and 380 are positioned that such deck assembly 200 is fully reclined and when actuator 370 is positioned such that frame assembly 300 is in its lowermost position; e.g., when high-low leg assembly 315 is positioned as shown in FIG. 10. Back frame assembly 305 and foot frame assembly 350 are shown in their disassembled position. As disassembled, angle irons 331 and 332 of high low angle assembly 330 are disabled by securing same to cross member 310 as is best shown in FIG. 12, by inserting headed pin 410 upwardly through opening 335 of plate 334 and aligning pin 410 with opening 311 in cross member 310 and securing pin 410 by spring clip 415.

Figure 11:
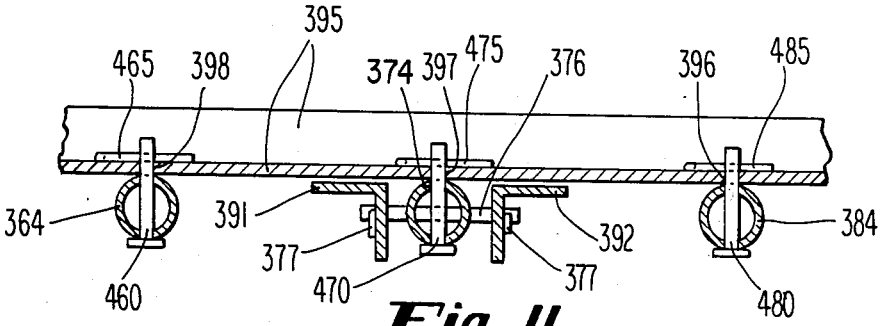
FIG. 11 is a sectional view taken along the lines 11—11 of FIG. 10.

Turning now to FIGS. 10 and 11, with particular attention drawn to foot frame assembly 350, it can be seen that high-low actuator tubing 374 is secured to high low actuator channel members 391 and 392 respectively by pin 376 passing therethrough (openings not shown) and being secured by snap rings 377. Referring particularly to FIG. 11, the tubular members of the actuators are all shown as being disabled in that when foot frame assembly 350 is disassembled from body supporting unit 1, it is preferable to secure the tubular members for transportation, storage and the like. Thus pin 460 passes through tubular member 364 and secures tubular member 364 with cross member 395 by passing through opening 396 and being secured therewith by spring clip 465. High low tubular member 374 is likewise secured by pin 470 which passes through its openings 379 and opening 397 of cross member 395 and is secured by spring clip 475. Tubular member 384 is secured by pin 480 which passes through opening 398 on cross member 395 and is secured by spring clip 485.

Figure 9:
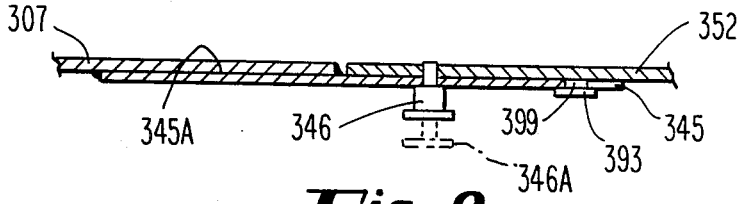
FIG. 9 is a sectional view taken along the lines 9—9 in FIG. 8.
Figure 13:
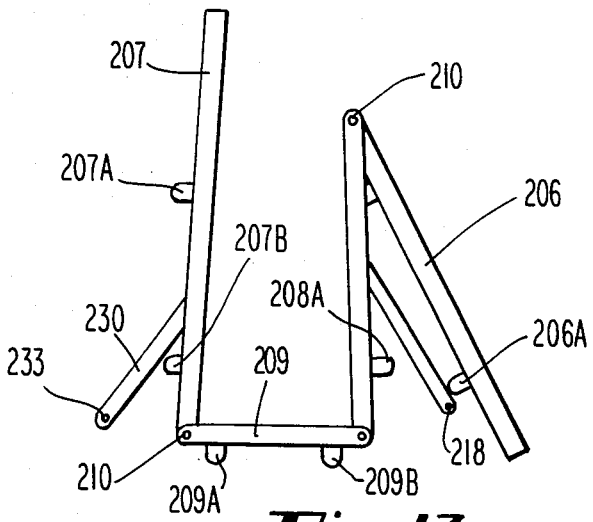
FIG. 13 is a view of the spring deck assembly of the present invention as folded and ready for transport.

In assembling frame assembly 300 reference is made to FIG. 10 where it can been seen that tongues 345 are positioned such that receptacles 348 are beneath headed means 393 and then raised upwardly to engage body 399 of headed means 393 as is shown in FIG. 9 whereupon foot frame assembly 350 is brought into alignment with back frame assembly 305 by withdrawing spring pull mechanisms 346 to position 346A as shown in FIG. 9 to position pins 347 such that the ends are flush with surface 345A and then aligning pins 347 with openings 394 and releasing push pull pin 346 so that pin 347 enters openings 394 which thus engages side frame members 352 (FIG. 9) and 353 (FIG. 10) forming an integral frame assembly 300. The next step in the assembly of unit 1 is to engage high-low assembly 315 and particularly to connect high-low channel angle irons 392 with 332 and 391 with 331. This is accomplished by first releasing high low angle irons 331 and 332 from the disabled position as shown in FIG. 10 and FIG. 12 by removing pin 410 after spring clip 415 is removed, aligning openings 399 of channel angle irons 392 and 391 (FIG. 10) with openings 333 of channel angle irons 332 and 331 (not shown) and passing pin 495 through the openings 333 and 392 of high-low angle irons 391, 331, 392 and 332 respectively, and securing pin 495 with spring clips (not shown) on each end of pin 495.

Frame assembly 300 is now ready to receive spring deck 300 which is connected therewith by first aligning openings 222 of saddle stud 220 with studs 340 of slide-off stud means 338 while retracting release pull 341 such that the outermost surface of pin 343 is flush with surface 342A of release pull plate 342 providing sufficient clearance for release pull saddle 225 to be pivoted downwardly into alignment with pin 343 whereby release pin 341 may be disengaged from its retracted position, with pin 343 thereby entering opening 227 of release pull saddle 225 as is best shown in FIG. 7. Actuator tubes 364 and 384 are released from their disabled positions (FIG. 11) by removing pins 460 and 480 after disengagement of spring clips 396 and 398, respectively. Tubular member 364 is provided with openings 367 which are aligned with openings 218 of knee lifting fork 215 which straddles actuator tubing 364 whereby pin 460 may be utilized to pass through the above described openings to secure knee lifting fork 215 with tubular member 364 by using pin clip 465. Likewise, tubular member 384 is disengaged from its disabled position by removing pin clip 485 and pin 480 and thereafter aligning openings 387 with openings 233 of back lifting fork 230 wherein members 231A straddle tubular member 384. Pin 480 may be used and inserted into openings 233 and 387 and tubular member 384 secured to back lifting fork 230 by means of pin 480 and clip 485.

3. Operation of Unit

Figure 4:
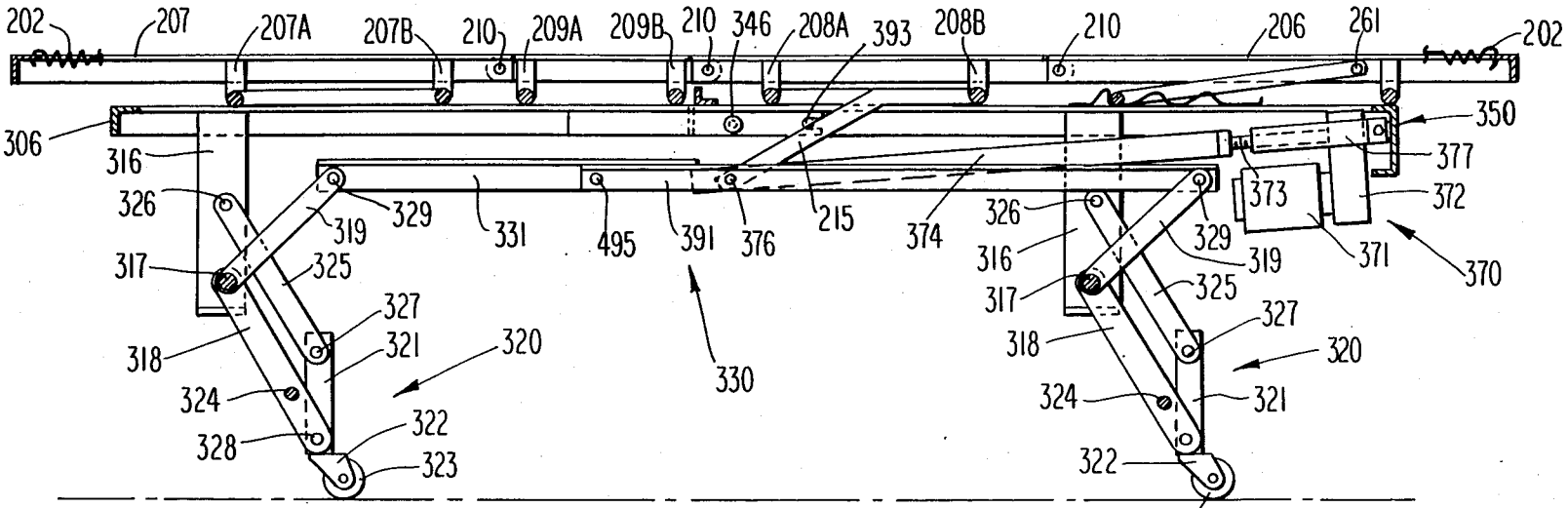
FIG. 4 is a sectional view taken along the lines 4—4 in FIG. 3.
Figure 6:
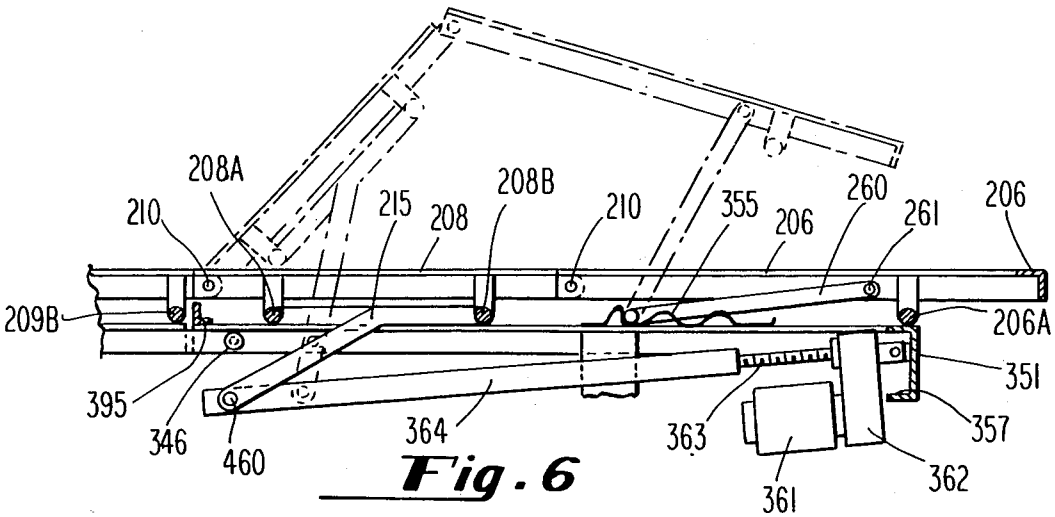
FIG. 6 is a sectional view taken along the lines 6—6 of FIG. 3.
Figure 5:
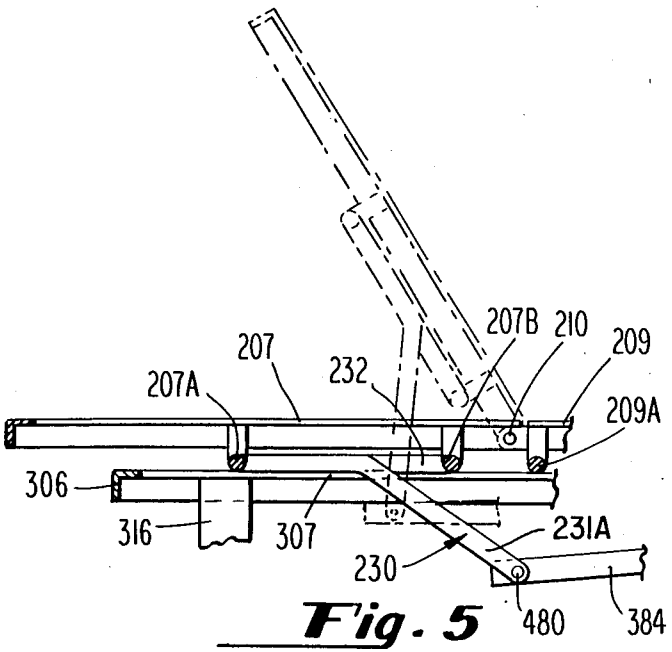
FIG. 5 is a sectional view taken along the lines 5—5 in FIG. 3.

Operation of unit 1 can best be observed by reference to FIGS. 4, 5 and 6. In the preferred embodiment of the present invention, a hand held switched device (not shown) controls actuation means 360, 370 and 380 and is electrically connected with reversible motors 361, 371, and 381. High-low leg assemblies 315 and actuation means 330 are best illustrated in FIG. 4 which shows frame assembly 300 in almost fully raised or at the highest position. The switch means for high low actuator 370 merely operates reversible motor 371 in one direction or the other. To lower leg assemblies 315 and therefore frame assembly 300, the hand held switched device is appropriately switched to activate motor 371 in the appropriate direction whereby screw 373 is rotated in a manner which causes tubular member 374 to move outwardly from and away from gear box 372 which as viewed in FIG. 4 moves high-low actuation means 330 leftwardly whereby lever arms 319 and therefore tubular members 317 move in a counter clockwise manner, which has the attendant effect of lowering frame assembly 300. At the point where lever arm 317 has aligned itself with supporting posts 316, namely the two are in effect parallel with each other, a limitor (not shown) engages bearing 376 which is affixed to plate 377 stopping screw 373 which halts its movement and stops motor 371. To raise unit 1, hand held switched means is activated in a manner which causes the motor 371 to rotate in a fashion which rotates screw 373 in a manner which retracts tubular member 374 until the limitor, which can be a pin inserted through screw 373, engages limit stop 378. The movement of high-low angle assembly 330 rightwardly, when viewed in FIG. 4, causes lever arm 319 to rotate in a clock-wise manner thus raising frame assembly 300 to any desired height until the limitor engages bearing 376 to halt screw 373 and motor 371 from further operation, whereupon unit 1 has reached its maximum height.

The manner in which actuator means 360 operates to move spring deck 200 is best shown in FIG. 6. As shown in solid lines, spring deck 200 is in its fully reclined position and tubular member 364 is fully extended away from gear box 362. When the hand held device is appropriately switched, motor 361 turns screw 363 in a manner which tends to move tubular member 364 toward gear box 362 which causes saddle section 208 to pivot about its left most pivot point 210 in a counter clockwise direction and ultimately in the raised position illustrated in dotted lines (FIG. 6). As saddle deck 208 is being raised in counter clockwise fashion by virtue of movement of tubular member 364 and rotation of knee fork 215, spring deck section 208 is also moved about a predetermined preselected pivot point, determined by the location of engagement by foot support bar 260 with selector ratchet 355, which causes foot spring decking 206 to be raised at pivot point 210 (connecting saddle 208 and decking 206) as positioned by leg support bar 260 and its pivotal movement about selector ratchet 355. The dotted illustration in FIG. 6 represents the uppermost position of spring deck 200 whereupon the rotation screw of 363 is halted by a limitor (not shown) secured thereto, which deactivates motor 361. To lower spring deck 200 from the dotted position, the hand held device is simply switched in the appropriate direction to cause motor 361 to rotate screw 363 through gear box 362 in the opposite direction, causing tubular member 364 to move again outwardly from and away from gear box 362 causing spring deck 200 to lower to the fully inclined position, whereupon motor 361 is deactivated.

Turning now to FIG. 5 the movement of back deck spring deck 205 is illustrated in fully reclined position shown in solid lines and in the fully raised position shown in dotted lines. In the fully reclined position, tubular member 384 is at its innermost position in relation to gear box 382 and upon actuation of motor 381 which operates through gear box 382 to turn screw 383, tubular member 384 is moved outwardly away from gear box 382 which rotates back lifting fork 230, and back deck 205 which is connected therewith, pivotally about pivot point 210 (which connects saddle deck 209 with back decking 205), and upwardly in a clockwise manner until pivotal movement is halted by a limitor (not shown) on screw 283 when back decking 205 reaches its uppermost position as illustrated in dotted lines (FIG. 5). To lower back decking 205 the hand held device is switched in the appropriate manner to reverse motor 381 to cause screw 383 to turn in a manner which retracts tubular member 384 toward gear box 382, lowering back decking 205 until it rests against back frame assembly 305, whereupon motor 381 is deactivated.

As hereinbefore described, it is clear that the hand held switched device can be utilized in any sequence to adjust frame assembly 300 and therefore spring deck 200 into various heights, and be utilized to adjust back spring deck 205 (FIG. 5) and knee and leg support decking 208 and 206 (FIG. 6) into various positions to accommodate various needs and/or comfort as required by an individual using unit 1. While not illustrated, it should be understood that mattress 4 is so constructed such that it will conform to the shape of the various spring deck members 200.

While the foregoing description is representative of the preferred embodiment of the present invention it should be understood that the present invention is directed to other embodiments and variations consistent with the specification, referenced drawing figures and appended claims as is evident to one of ordinary skill in the art in reviewing these descriptions, claims and related materials.

What is claimed is:

1. A portable bed assembly including a spring deck assembly and a separable frame assembly comprising: spring deck assembly means for supporting a patient in multiple positions, said spring deck assembly means being separable from said seperable frame assembly, portable and foldable to facilitate transport; and separable frame assembly means for releasable engagement with and support of said spring deck assembly means in said multiple positions, said separable frame assembly means being separable to facilitate transport.

2. A portable bed assembly as in claim 1, wherein said separable frame assembly means includes first and second frame components and latching means for alignment of and releasably securing said first and second frame component, to form an integral, aligned, yet seperable frame assembly.

3. A portable bed assembly as in claim 2, wherein said first and second frame components each include corresponding high-low means releasably secured to each other to form an integral assembly for uniformly raising and lowering said frame assembly means.

4. A portable bed assembly as in claim 2, wherein said spring deck assembly comprises saddle deck means having means for releasably securing said saddle deck means to one of said frame components, back deck means pivotally secured to said saddle deck means, and knee deck means pivotally secured to said saddle deck means.

5. A portable bed assembly as in claim 4, wherein one of said frame components comprises back actuating means, releasably coupled to said back deck means, for pivoting said back deck means about said saddle deck means.

6. A portable bed assembly as in claim 5, wherein said back actuating means comprises a longitudinally extensible member releasably pivotally coupled to said back deck means.

7. A portable bed assembly as in claim 6, further including means for releasably securing said longitudinally extensible member to said one of said frame components when said spring deck assembly means is seperated from said separable frame assembly and said one of said frame components is separated from the other frame component.

8. A portable bed assembly as in claim 6, wherein said back deck means comprises rigidly attached fork means, said fork means having a pair of fork members having apertures therethrough, said longitudinally extensible member having an aperture therethrough, whereby said back deck means may be pivotally releasably coupled to said longitudinally extensible member by passing a pin through said apertures.

9. A portable bed assembly as in claim 4, wherein one of said frame components comprises knee actuating means, releasably coupled to said knee deck means, for pivoting said knee deck means about said saddle deck means.

10. A portable bed assembly as in claim 9, wherein said knee actuating means comprises a longitudinally extensible member releasably pivotally coupled to said knee deck means.

11. A portable bed assembly as in claim 10, further including means for releasably securing said longitudinally extensible member to said one of said frame components when said spring deck assembly means is separated from said separable frame assembly and said one of said frame components is separated from the other frame component.

12. A portable bed assembly as in claim 10, wherein said knee deck means comprises fork means rigidly attached thereto, said fork means having a pair of fork members having apertures therethrough, said longitudinally extensible member having an aperture therethrough, whereby said knee deck means may, be pivotally releasably coupled to said longitudinally extensible member by passing a pin through said apertures.

13. A portable bed assembly according to claim 3, wherein one of said frame components comprises high-low actuating means releasably secured to said high-low means.

14. A portable bed assembly according to claim 13, wherein said high-low actuating means comprises a longitudinally extensible member.

15. A portable bed assembly according to claim 14, further comprising means for releasably securing said longitudinally-extending member to said one of said frame components when it is separated from the other frame component.

16. A portable bed assembly comprising:

deck means forming a resilient, body supporting, foldable surface, for supporting a person reclined thereon throughout a range of multiple positions;

integral frame means for supporting said deck means throughout said range of said multiple positions, said frame means being separable into two component parts;

securing means for releasably securing said frame means with said deck means in a manner which is not intrusive of movement of said deck means and throughout said range of said multiple positions, whereby said deck means is quickly releasable from said frame means; and actuator means releasably secured with said deck means for independently pivoting a back supporting portion and a knee supporting portion of said deck means throughout said range of said multiple positions, whereby said deck means and said frame means may quickly be disassembled into three component parts and reassembled to facilitate delivery and installation by an individual.

17. A portable and separable bed assembly including a deck assembly and a frame assembly comprising:

a deck assembly including a back supporting portion pivotally connected with a saddle portion, said saddle portion being pivotally connected with a knee supporting portion, said knee supporting portion being pivotally connected with a foot portion, said back portion including back fork means for engagement with said frame assembly to pivot said back supporting portion in relation to said saddle portion of said deck assembly throughout various positions, said saddle portion including saddle means mateable with stud means and pin means, said knee supporting portion including knee fork means for engagement with said frame assembly to pivot said knee supporting position in relation to said saddle portion of said deck assembly throughout various positions, said foot portion inluding pivotal foot support bar means;

a first frame component of said frame assembly comprising stud means including releasable pin means for engagement with said saddle means of said saddle portion of said deck assembly, first pivoting leg assembly means engaging said first frame component, first high-low means engaging first pivoting leg assembly means, and releasable alignment means including pull-pin means and receptacle means; and a second frame component of said frame assembly comprising second pivoting leg assembly means engaging said second frame component, second high-low means releasably attached to said first high-low means, receiving alignment means including headed means for fitted engagement with said receptacle means and means for receipt and engagement of said pull pin means for releasable engagement with said alignment means, selector ratchet means for engagement with said pivotal foot support bar means and for providing a pivot about which said foot portion and thus said knee portion of said deck assembly rotate, and actuator means releasably connected with said second high-low means, said back fork means, and said knee fork means for independent movement of said second high-low means, and said back fork and knee fork means in relation to said frame assembly.

* * * * *